US008905825B2

(12) United States Patent
Huff

(10) Patent No.: US 8,905,825 B2
(45) Date of Patent: Dec. 9, 2014

(54) CONTAINER FOR STORING KNIFES, UTENSILS, AND THE LIKE HAVING INTEGRAL BLADE SHARPENER

(75) Inventor: Bernard G. Huff, Belton, MO (US)

(73) Assignee: Hantover, Inc., Overland Park, KS (US)

( * ) Notice: Subject to any disclaimer, the term of this patent is extended or adjusted under 35 U.S.C. 154(b) by 33 days.

(21) Appl. No.: 13/413,722

(22) Filed: Mar. 7, 2012

(65) Prior Publication Data

US 2013/0237137 A1 Sep. 12, 2013

(51) Int. Cl.
*B23F 21/03* (2006.01)

(52) U.S. Cl.
USPC ..... 451/555; 451/556; 451/344

(58) Field of Classification Search
USPC ..... 451/321, 344, 552, 555, 556
See application file for complete search history.

(56) References Cited

U.S. PATENT DOCUMENTS

| | | | | |
|---|---|---|---|---|
| 3,135,383 | A * | 6/1964 | Bloch | 206/553 |
| 3,583,104 | A * | 6/1971 | Petroske et al. | 451/241 |
| 4,866,845 | A * | 9/1989 | McEvily | 30/138 |
| 5,494,176 | A * | 2/1996 | Zallo | 211/70.7 |
| 6,082,559 | A | 7/2000 | Levsen | |
| 6,224,475 | B1 * | 5/2001 | May et al. | 451/555 |
| 6,439,403 | B1 | 8/2002 | Levsen | |
| 6,581,774 | B1 * | 6/2003 | Galafassi et al. | 206/553 |
| D483,624 | S * | 12/2003 | Bradshaw | D7/638 |
| 7,198,558 | B2 | 4/2007 | Levsen | |
| 7,381,120 | B2 * | 6/2008 | Henry | 451/439 |
| 7,637,803 | B2 * | 12/2009 | Welch | 451/552 |
| 2005/0205506 | A1 * | 9/2005 | Siegel | 211/70.7 |
| 2007/0167122 | A1 * | 7/2007 | Henry | 451/523 |
| 2008/0171504 | A1 * | 7/2008 | Smith | 451/540 |
| 2008/0173772 | A1 * | 7/2008 | Welch | 248/37.3 |
| 2008/0274675 | A1 * | 11/2008 | Chen | 451/65 |
| 2011/0136412 | A1 * | 6/2011 | Dovel | 451/45 |

OTHER PUBLICATIONS

Printout from Amazon.com showing Chicago Cutlery Insignia 2 (printout dated Jan. 30, 2012).

* cited by examiner

*Primary Examiner* — Eileen P. Morgan
(74) *Attorney, Agent, or Firm* — Hovey Williams LLP

(57) ABSTRACT

A container for storing at least one object, such as a knife, utensil, and the like, wherein the object has a blade that is occasionally dressed is disclosed. The container includes a housing presenting an object-receiving opening and a blade-dressing assembly configured to provide selective dressing of the blade. The blade-dressing assembly includes a carrier and a dressing component supported on the carrier. The carrier is shiftably supported on the housing so as to move between a storage position in which the dressing surface is incapable of engaging the blade and an operating position in which the dressing surface is engageable by the blade.

18 Claims, 5 Drawing Sheets

CONTAINER FOR STORING KNIFES, UTENSILS, AND THE LIKE HAVING INTEGRAL BLADE SHARPENER

BACKGROUND OF THE INVENTION

1. Field of the Invention

The present invention relates generally to devices for holding knives and/or other utensils. More specifically, the present invention concerns a container, such as a knife block, having a blade dressing assembly pivotally mounted therewith.

2. Discussion of Prior Art

Those ordinarily skilled in the art will appreciate that utensils often become worn through regular use. For instance, knife blades may become worn by continuous use of the knife's blade to cut a variety of foodstuffs, such as for instance, frozen foods, that may cause the blade to dull. Moreover, knives are often used with cutting boards, which may be formed of wood, granite, or some other hard material. Continually using a knife on a cutting board may accelerate wear of the blade because of continual contact with the cutting board. Thus, after long and repeated use, a knife's blade may require conditioning, or dressing, to restore and/or enhance the blade's performance characteristics. Different dressing techniques exist to restore and/or enhance blade performance, such as, for instance, sharpening, straightening, honing, polishing, buffing, and the like. Such dressing techniques may refurbish or restore the blade to optimal conditions for use.

Notwithstanding the need for dressing utensils, such dressing tools are often inconvenient to store and use. For instance, some knife blocks include a storage slot for butcher steels or sharpening rods. Storing dressing utensils in the knife block, however, sacrifices storage space for other utensils. Alternatively, if a dressing apparatus like a sharpening stone is stored elsewhere, the sharpener may be lost or it may not be conveniently accessible for use when required.

SUMMARY OF THE INVENTION

Responsive to these and other problems, an important object of the present invention is to provide a container for storing at least one object, such as a knife, utensil, and the like, wherein the object has a blade that is occasionally dressed.

According to a first aspect of the present invention, the utensil holder comprises a housing and a blade-dressing assembly. The housing presents an object-receiving opening. The blade-dressing assembly is configured to provide selective dressing of a blade. The blade-dressing assembly includes a carrier and a dressing component supported on the carrier. The dressing component presents a dressing surface that is configured to engage the blade and thereby dress the blade when the blade is moved relative to the dressing surface. The carrier is shiftably supported on the housing so as to move between a storage position and an operating position. When the carrier is in the storage position the dressing surface is incapable of engaging the blade. When the carrier is in the operating position the dressing surface is engageable by the blade.

Other aspects and advantages of the present invention will be apparent from the following detailed description of the preferred embodiments and the accompanying drawing figures.

This summary is provided to introduce a selection of concepts in a simplified form that are further described below in the detailed description of the preferred embodiments. This summary is not intended to identify key features or essential features of the claimed subject matter, nor is it intended to be used to limit the scope of the claimed subject matter.

BRIEF DESCRIPTION OF THE DRAWING FIGURES

Preferred embodiments of the invention are described in detail below with reference to the attached drawing figures, wherein.

Figure 1:
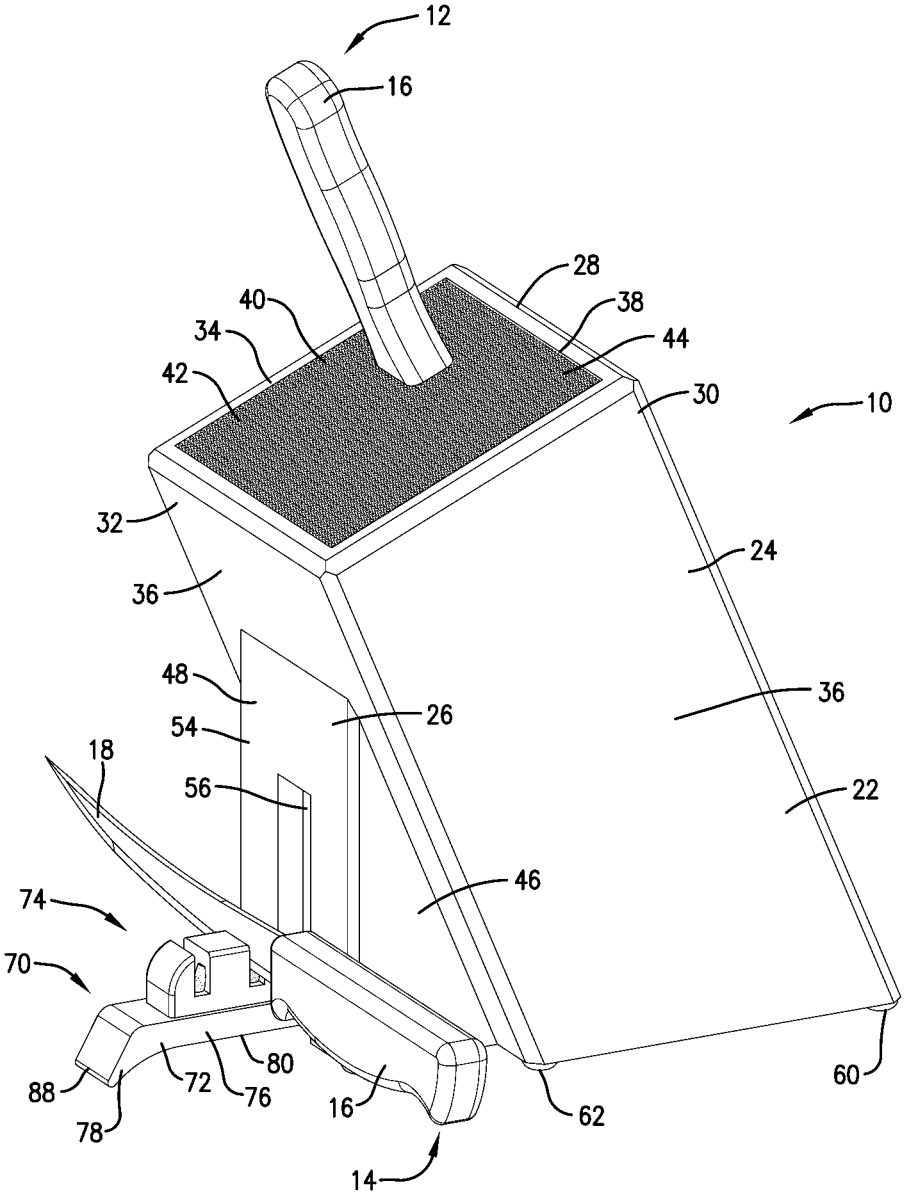
FIG. 1 is a top perspective view of a container for storing at least one object, such as a knife, utensil, and the like, constructed in accordance with the principles of a preferred embodiment of the present invention, with the container being depicted with the carrier in the operating position and operable to dress a knife's blade.

The drawing figures do not limit the present invention to the specific embodiments disclosed and described herein. The drawings are not necessarily to scale, emphasis instead being placed upon clearly illustrating the principles of the preferred embodiments.

DETAILED DESCRIPTION OF THE PREFERRED EMBODIMENTS

With reference to the drawings, wherein like reference numerals designate like parts and assemblies throughout the several views, the container 10 selected for illustration is designed to universally accommodate a plurality of objects, such as knives, utensils, tools, and the like. More particularly, the illustrated container 10 is similar to the device generally described in U.S. Pat. No. 6,082,559. Alternatively, the container 10 could be designed to include a retainer having a plurality of side-by-side web members presenting a utensil-receiving opening between adjacent ones of the web-members, as generally described in U.S. Pat. No. 6,439,403. The entire disclosures of U.S. Pat. Nos. 6,082,559 and 6,439,403 are hereby incorporated by reference herein in their entireties. Moreover, according to some aspects of the present invention, the container 10 could alternatively be a traditional slotted knife block, having a plurality of slots each sized to receive a corresponding knife or utensil. Those of ordinary skill in the art will readily recognize that the container 10 disclosed herein could be variously configured and designed such any one of a number of containers may be suitably employed and are within the scope of the present invention.

The container 10 is shown in use with a pair of knives 12,14. It will be appreciated, however, the container 10 could be used with other utensils, such as potato peelers, scissors, other types of cutlery, spatulas, whisks, spoons, tongs, and the like. Most preferably, the container 10 is used with objects requiring dressing/conditioning. The illustrated knives 12,14 each include a handle 16 and a blade 18 projecting from the handle 16. In the usual manner, the blade 18 is narrower than the handle 16 such that a flange 20 (see FIG. 2) is defined generally at the junction of the blade 18 and handle 16.

Figure 4:
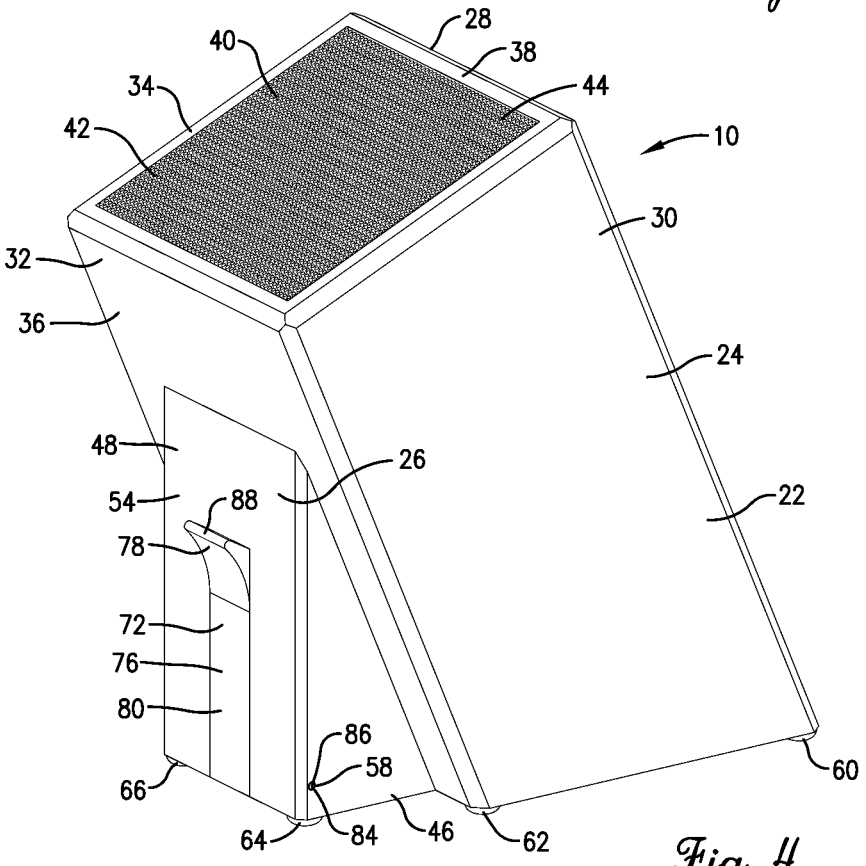
FIG. 4 is a top perspective view of the container with the carrier shown in the storage position.

With reference generally to FIGS. 1 and 4, the illustrated container 10 includes a housing 22 preferably formed of a material capable of withstanding the environmental conditions in which the container will be used. Accordingly, the illustrated housing is formed of wood, but the housing may be formed of any other suitable material, such as plastic, synthetic resin, steel, and the like. The housing 22 generally includes a case 24 and a support 26 that supports the case 24 at an oblique angle relative to vertical. The case 24 is generally rectangular in shape and generally includes a plurality of upright walls 28,30,32,34, each of which presents an outer face 36. Although the illustrated case 24 does not present a bottom wall, a bottom wall may optionally be included and oriented generally perpendicularly to the upright walls 28,30, 32,34. The walls 28,30,32,34 cooperatively define an object-receiving opening 38 having a utensil-retaining rod assembly 40 therewithin. Although the container 10 illustrated in FIG. 1 is shown supporting only a single knife 12, it will be appreciated by those of skill in the art that a plurality of knives or various other utensils (e.g., a sharpening rod, a potato peeler, scissors, other types of cutlery, spatulas, whisks, tools, utensils, etc.) may be placed in the container simultaneously.

In the illustrated embodiment, the container is provided with a rod assembly 40 similar to that described in U.S. Pat. No. 6,082,559. The rod assembly 40 comprises a plurality of generally cylindrical rods 42, which present a common length and are substantially equal in cross-section and formed of plastic. The free ends of rods 42 are flat, but optionally rounded, and cooperatively define an entry face 44 spanning the case opening 38 so that a utensil, such as knife 12, pierces through the entry face and passes along the length of the rods for storage. As with U.S. Pat. No. 6,082,559, the rods 42 are preferably fixed axially relative to one another by any suitable means.

The support 26 is preferably adhesively bonded to the case 24 to form an integral portion of the housing 22 but may alternatively be removably affixed to the case 24. One of ordinary skill in the art will easily appreciate that the case 24 and support 26 may be connected and/or fabricated in any other suitable manner. The support 26 generally includes a plurality of walls 46,48,50 that cooperatively define a hollow interior defining a storage area 52. Each of the walls 46,48,50 additionally present an outer surface 54, with the center support wall 48 including a carrier-receiving slot 56 defined therein. The slot 56 runs from the base of the center support wall 48 substantially the entire height of the wall 48, but may be variously dimensioned. The center support wall 48 additionally includes a support bore 58 transecting the carrier-receiving slot 56. The slot 56 operably provides access to the hallowed internal storage area 52 defined by the support 26 and the case 24 (see FIG. 6). The illustrated support 26 optimally stabilizes the case 24 so that the container 10 does not tip or wobble when objects are added to, or removed, from the case 24. Again the case 24 is preferably oriented at an oblique angle relative to the surface on which it is supported, so as to facilitate access to the opening 38 thereof.

The illustrated container 10 is supported on the surface on which it sits by a plurality of feet 60,62,64,66,68. In particular, the feet 60,62,64,66,68 are preferably adhesively attached to the bottom of the case 24 and support 26 and formed of nonslip material, such as rubber. Those of skill in the art will readily recognize that other materials may suitably be used to form the feet 60,62,64,66,68. Likewise, other suitable fasteners may be used to affix the feet 60,62,64,66,68 to the case 24 and support 26.

Figure 2:
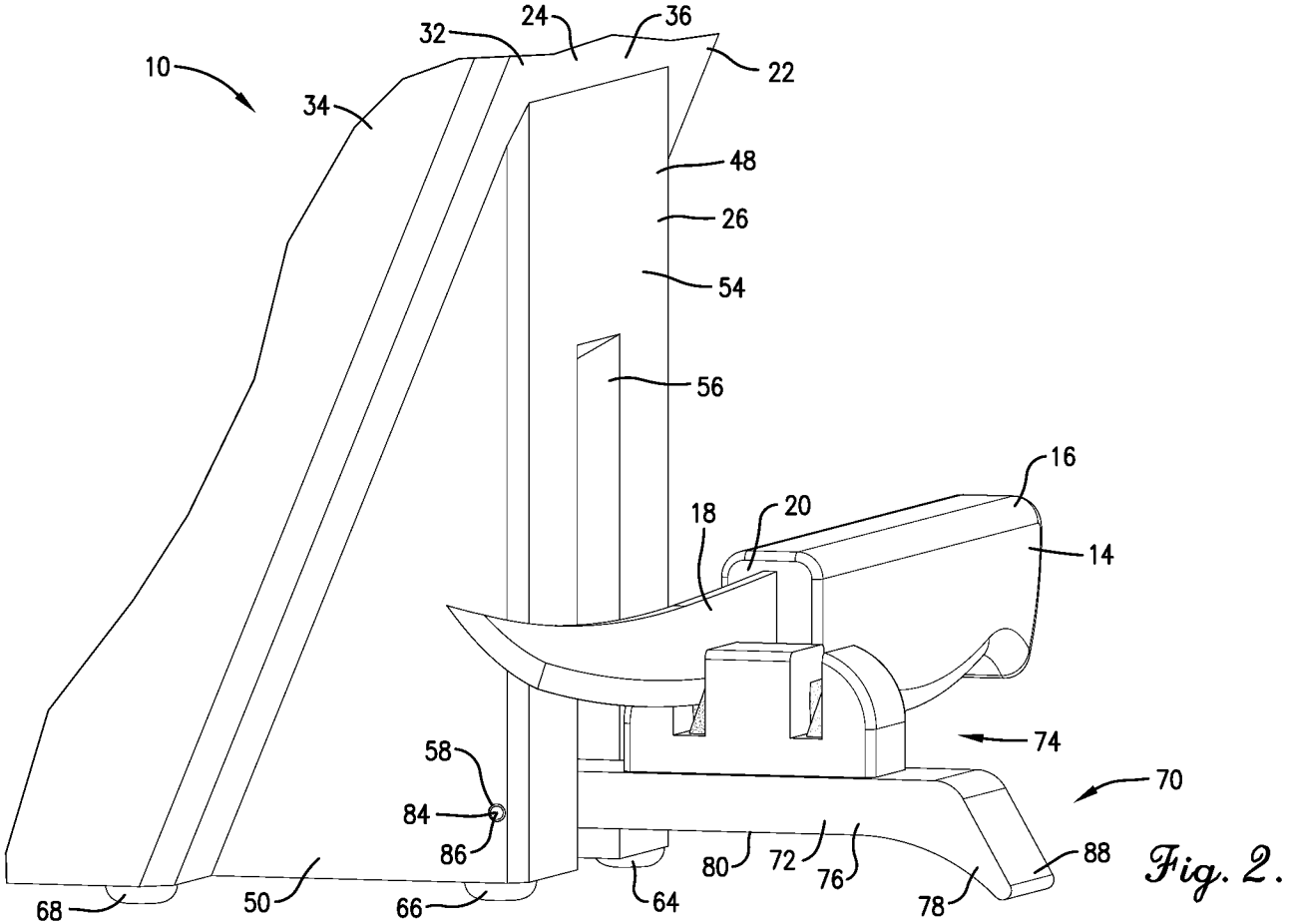
FIG. 2 is an enlarged fragmentary perspective view of the container depicted with the carrier in the operating position and operable to dress a knife's blade.
Figure 3:
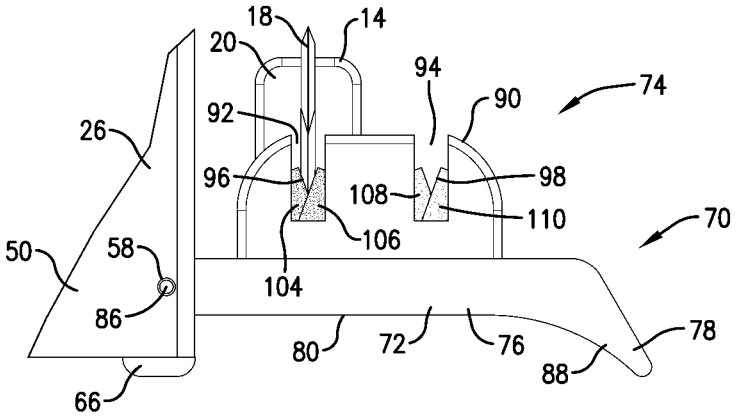
FIG. 3 is an enlarged fragmentary elevation view of the container with the carrier in the operating position and operable to dress a knife's blade.
Figure 5:
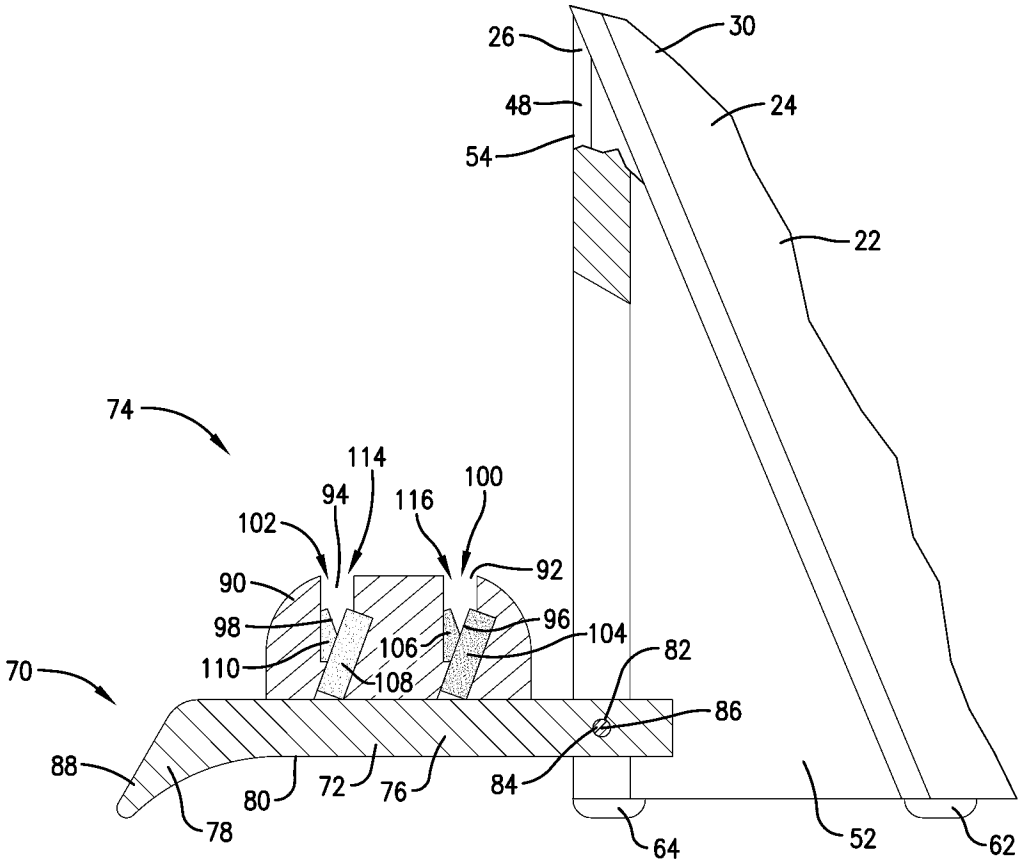
FIG. 5 is a greatly enlarged fragmentary cross-sectional view of the container with the carrier in the operating position.

Now referring generally to FIGS. 2, 3, and 5, the illustrated container 10 includes a blade-dressing assembly 70 that provides convenient dressing of the knives 12,14. The blade-dressing assembly 70 is shiftably connected to the housing 22 and, more preferably, is pivotally attached to the support 26. It will be appreciated, however, that the blade-dressing assembly 70 may be associated with the housing 22 in any suitable manner, although it is important that the blade-dressing assembly 70 be configured to permit only selective dressing of a blade, as will be described.

The blade-dressing assembly 70 generally includes a carrier 72 and a dressing component 74 supported thereby. More particularly, the illustrated carrier 72 is generally rectangular in shape and includes a body portion 76 and a projecting portion 78, both of which are preferably integrally formed as part of the carrier 72. The body portion 76 presents an outer face 80 that is generally flat and additionally includes a bore 82 (see FIG. 5) co-axially arranged with the support bore 58 with the respective bores 58,82 cooperatively receiving a cross-member 84 spanning the respective bores 58,82 to define an axis 86 of rotation about which the carrier 72 may be swung. As will be further described herein, the carrier 72 swings about the axis 86 relative to the housing 22 between a storage position, shown, for instance, in FIG. 4, and an operating position, shown, for instance, in FIG. 3.

The projecting portion 78 of the carrier 72 serves several functions depending upon the position of the carrier 72. In particular, when the carrier 72 is in the storage position (FIGS. 4 and 6), the outer face 80 of the body portion 76 is generally flush with the outer surface 54 of the support 26. Accordingly, when the carrier 72 is in the storage position, the projecting portion 78 operably extends outwardly from the flush outer faces 54,80 of the support 26 and body portion 76 to define a handle 88 that is manually graspable and configured to be pulled to rotate the carrier 72 away from the support 26 about the axis 86 of rotation. Alternatively, when the carrier 72 is in the operating position (FIGS. 2, 3, and 5), the projecting portion 78 operably engages the surface upon which the container 10 rests and spaces the body portion 76 of the carrier 72 from the surface. Spacing the body portion 76 from the surface facilitates storage of the blade-dressing assembly 70, as will later be described, and preferably stabilizes the blade-dressing assembly 70 for use. Moreover, the illustrated projecting portion 78 is dimensioned relative to the axis 86 of rotation to level the body portion 76 with the surface upon which the carrier 72 rests. Therefore, the axis 86 illustrated in the preferred embodiment is positioned and the projecting portion 78 is configured to support the body portion 76 in a generally horizontal orientation when the carrier 72 is in the operating position.

Although the projecting portion 78 illustrated herein is integrally formed with the body portion 76 as part of the carrier 72, the projecting 78 portion may operably be formed of a separate structure, such as a knob, affixed to the body portion 76 with some type of adhesive or mechanical fastener, such as a screw. Those of ordinary skill in the art will readily recognize the vast array of structures capably projecting from the outer face 80 of the body portion 76. Moreover, while the illustrated projecting portion 78 is distal from the axis 86 of rotation, the projecting portion 78 can be variously shaped, sized, and positioned along the carrier 72 to accommodate various design preferences while still achieving the above-described functions. To be sure, the projecting portion 78 can be variously placed along the body portion 76 and may be located more proximate the axis 86 of rotation. In addition, the projecting portion 78 may be dimensioned and/or may be positioned relative to the axis 86 of rotation to orient the body portion 76 in alternative angles for presenting the blade-dressing assembly 70 to a user for selective dressing of a blade.

Referring now to FIGS. 3 and 5, the illustrated carrier 72 includes a generally arcuate slot-defining portion 90 opposite the outer face 80 of the body portion 76. The slot-defining portion 90 presents first 92 and second 94 spaced apart slots, each of which is configured to receive a blade for selective dressing therein. In particular, each slot 92,94 defined by the slot-defining portion 90 is oriented substantially perpendicular to the longitudinal axis of the body portion 76. Therefore, in the illustrated embodiment, when the carrier 72 is in the operating position, the slots 92,94 assume a substantially vertical orientation. The slots 92,94 operably present the dressing component 74 of the blade-dressing assembly 70. More particularly, the dressing component 74 includes first 96 and second 98 dressing surfaces within respective first 92 and second 94 slots. In the illustrated embodiment, a first pair of spaced apart dressing members 100 within the first slot 92 define a first pair of opposed sections 102 of the first dressing surface 96, which are configured to simultaneously engage opposite sides of the blade 18. Indeed, the first dressing surface 96 illustrated in FIG. 3 shows a blade 18 engaged therewith and the blade 18 is thereby dressed when moved relative to the first dressing surface 96. Most preferably, each of the respective dressing surfaces 96,98 is defined by ceramic sharpening rods 104,106,108,110 having a generally cylindrical shape and having an abrasive grit embedded therewithin or coated thereon. The rods 104,106,108,110 may be sized and/or shaped as desired, and may further include suitable grit or dressing characteristics to provide different blade conditioning. Moreover, the respective dressing surfaces 96,98 may alternatively be formed of a unitary sharpening stone having a notch formed therein, with respect notch walls cooperatively defining the respective dressing surfaces.

Likewise, the second dressing surface 98 is defined within the second slot 94 of the slot-defining portion 90 of the carrier 72. A second pair of spaced apart dressing members 114 within the second slot 94 define a second pair of opposed sections 116 of the second dressing surface 98, which are configured to simultaneously engage opposite sides of the blade 18. The second dressing surface 98 is engageable in a manner similar to the first dressing surface 96 for dressing a blade 18 engaged therewith. Those of skill in the art will note, however, that the first 96 and second 98 dressing surfaces of FIG. 3 are differently configured so that different dressing characteristics are imparted thereby. Accordingly, the dressing component 74 illustrated in FIGS. 3 and 5 presents two dressing surfaces 96,98, each of which operably dresses the blade 18 to a different degree. While the respective pairs of dressing members 100,114 defining respective dressing surfaces 96,98 illustrated herein both present dressing surfaces designed to sharpen the blade 18, alternative configurations are possible and the dressing members 100,114 may be oriented with respect to each other to provide differing dressing surfaces 96,98 or comprise any material suitable for dressing a blade 18, such as, for instance, for sharpening, straightening, honing, polishing, buffing, and the like. Thus, one dressing surface may be suitable for steeling while the second dressing surface may be suitable for honing. One of skill in the art can easily appreciate the vast combinations possible. Moreover, while the illustrated blade-dressing assembly 70 presents two slots 92,94 for receipt of a blade 18 therein, the blade-dressing assembly 70 may be otherwise configured to present a single slot or more than two slots.

Again, the first and second slots 92,94 illustrated in FIGS. 3 and 5 are oriented with respect to the carrier 72 to be substantially vertical when the carrier 72 is in the operating position. Nevertheless, the carrier 72 and/or slots 92,94 may alternatively be configured to present the slots 92,94 at different and varying angles. For instance, the slots 92,94 may be canted within the slot-defining portion 90 and parallel with one another. Alternatively, the slots 92,94 may be canted within the slot-defining portion 90 and oriented at differing angles with respect to one another. The slots 92,94 may also be alternatively angled by dimensioning the projecting portion 79 of the carrier 72 so that the carrier 72 rests canted with respect to the surface on which the container 10 rests. Consequently, those of skill will easily appreciate the various possible configurations and orientations of the blade-dressing assembly 70 and dressing component 74.

The illustrated slot-defining portion 90 is preferably adhesively affixed to the body portion 76 to form an integral portion thereof, but those of skill in the art will readily recognize that other means for interconnection portions, such as mechanical or chemical fasteners, may operably be used. In addition, while the illustrated slot-defining portion 90 is permanently affixed to, and forming an integral portion of, the carrier 72, the slot-defining portion 90 may alternatively be removably affixed to the carrier 72 to facilitate replacement of the blade-dressing assembly 70 if desired. It is also noted that the body portion 76, projecting portion 78, and slot-defining portion 90 are all preferably formed of wood. In this manner the body portion 76, projection portion 78, and slot-defining portion 90 are preferably formed of the same material as the housing 22. Those of ordinary skill in the art will recognize, however, that the body portion 76, projection portion 78, and slot-defining portion 90 may be constructed of any suitable material.

Accordingly, the illustrated container 10 beneficially stores utensils and includes a blade-dressing assembly 70 shiftably affixed to the housing 22 thereof. In particular, the carrier 72 is ordinarily stored in the storage position (e.g., see FIGS. 4 and 6). In the storage position, access to and use of the dressing component 74 is prevented because the dressing component 74 is stored in the storage area 52 and therefore substantially inaccessible. Upon required dressing of a blade, the handle 88 defined by the projecting portion 78 of the carrier 72 is graspable and facilitates pulling on the carrier 72 to rotate the carrier 72 away from the housing 22 until the carrier 72 is in the operating position in which the blade 18 is selectively engageable with the dressing surfaces 96,98. Alternative designs of the carrier 72 may optionally forego a projecting portion 78 and opt instead for a spring-loaded push-release latching mechanism so that, for instance, the outer face 80 and outer surface 54 are more substantially flush.

Figure 6:
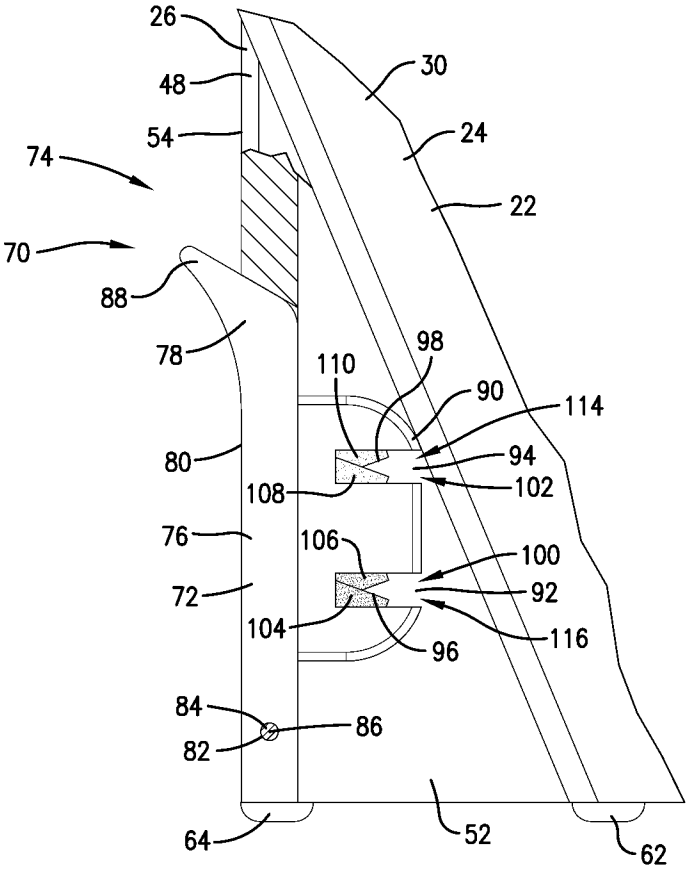
FIG. 6 is a greatly enlarged fragmentary elevation view of the container with the carrier in the stored position.

In the illustrated embodiment, the carrier 72 is in the operating position when the projecting portion 78 of the carrier 70 engages the surface upon which the container 10 rests (e.g., see FIGS. 1, 2, 3, and 5). A user may thereby dress a blade 18 using the blade-dressing assembly 70 in the known manner. Once the blade 18 has been dressed with the dressing component 74, the carrier 72 may be swung about the axis 86 toward the housing 22 toward the storage position. As previously discussed, the projecting portion 78 spaces the body portion 76 from the surface upon which the container 10 is supported, thereby enabling a user to slide a finger adjacent the outer face 80 of the body portion 76 of the carrier 72 to facilitate swinging the carrier 72 from the operating position. As the carrier 72 pivotally swings about the axis 86 from the operating position to the storage position, the illustrated blade-dressing assembly 70 passes through the carrier-receiving slot 56 of the support 26 and is received within the internal storage area 52 defined by the support 26 and the case 24 (see FIG. 6). The illustrated carrier-receiving slot 56 is configured to snugly accept the carrier 72 therethrough. The carrier 72 continues to swing until the slot-defining portion 90 of the carrier 72 abuts the housing 22, which thereby acts as a stop to prevent the carrier 72 from over-rotating. Moreover, as best shown in FIG. 6, the container 10 is configured so that the outer face 80 of the body portion 76 of the carrier 72 is substantially flush with the outer surface 54 of the housing 22 when the blade-dressing assembly 70 is in the storage position. Consequently, the dressing surfaces 96,98 are incapable of engaging a blade 18 when in the carrier 72 is in the storage position illustrated herein.

The preferred forms of the invention described above are to be used as illustration only, and should not be utilized in a limiting sense in interpreting the scope of the present invention. Obvious modifications to the exemplary embodiments, as hereinabove set forth, could be readily made by those skilled in the art without departing from the spirit of the present invention. Accordingly, the scope of the present invention will be limited only by the claims appended herein.

The inventor hereby states his intent to rely on the Doctrine of Equivalents to determine and assess the reasonably fair scope of the present invention as pertains to any apparatus not materially departing from but outside the literal scope of the invention as set forth in the following claims.

I claim:

1. A container for storing at least one object, such as a knife, utensil, and the like, wherein the at least one object has a blade that is occasionally dressed, said container comprising:

a housing presenting an object-receiving opening; and a blade-dressing assembly configured to provide selective dressing of the blade, said blade-dressing assembly including a carrier and a dressing component supported on the carrier, said dressing component presenting a dressing surface configured to engage the blade and thereby dress the blade when the blade is moved relative to the dressing surface, said carrier, and thereby the dressing component supported on the carrier, being supported for shifting movement relative to the housing so as to move between a storage position in which the dressing surface is incapable of engaging the blade and an operating position in which the dressing surface is engageable by the blade, said carrier being pivotally connected to the housing so as to swing between the storage and operating positions.

2. The container as claimed in claim 1, said housing presenting an outer surface, said carrier including a projecting portion that projects outwardly from the outer surface of the housing when the carrier is in the storage position, said projecting portion defining a handle to be manually grasped and pulled when the carrier is swung from the storage position to the operating position.

3. The container as claimed in claim 1, said housing presenting an outer surface, said carrier including an outer face that is generally flush with the outer surface of the housing when the carrier is in the storage position.

4. The container as claimed in claim 3, said carrier including a projecting portion that projects outwardly from the outer surface of the housing when the carrier is in the storage position, said projecting portion defining a handle to be manually grasped and pulled when the carrier is swung from the storage position to the operating position.

5. The container as claimed in claim 1, said carrier including a slot-defining portion having at least one blade-receiving slot in which the dressing component is located, said slot being at least substantially vertical when the carrier is in the operating position.

6. The container as claimed in claim 1, said housing presenting an internal storage area in which the blade-dressing assembly is at least substantially located when the carrier is in the storage position, said dressing component and at least part of the carrier being removed from the storage area when the carrier is in the operating position.

7. The container as claimed in claim 6, said housing including a case that defines the object-receiving opening, said housing including a support in which the storage area is defined, with the support being attached to the case.

8. The container as claimed in claim 7, said case being canted at an oblique angle relative to vertical, said support being generally upright relative to vertical.

9. The container as claimed in claim 1, said dressing component including a first pair of spaced apart dressing members defining a first pair of opposed sections of the dressing surface that are configured to simultaneously engage opposite sides of the blade.

10. The container as claimed in claim 9, said dressing component including a second pair of spaced apart dressing members defining a second pair of opposed sections of the dressing surface that are configured to simultaneously engage opposite sides of the blade, said second pair of opposed sections being configured to dress the blade to a different degree than the first pair of opposed sections.

11. The container as claimed in claim 9, said carrier including a slot-defining portion having at least one blade-receiving slot in which the dressing members are located, said slot being at least substantially vertical when the carrier is in the operating position.

12. The container as claimed in claim 1; and a rod assembly including a plurality of elongated, flexible rods, said rods being confined within the object-receiving opening in a manner that permits limited flexing movement of the rods, such that the object inserted into the opening is supported by the rod assembly and causes separation of adjacent ones of the rods to define a space that at least substantially collapses when the object is removed from the opening, said rods being restricted against lengthwise shifting relative to one another, said rods having common detached ends that cooperatively define an endmost entry face spanning the object-receiving opening so that the object pierces through the entry face and then passes along the length of the rods.

13. The container as claimed in claim 12, said rods being substantially equal in cross-sectional shape and size.

14. A container for storing at least one object, such as a knife, utensil, and the like, wherein the at least one object has a blade that is occasionally dressed, said container comprising:

a housing presenting an object-receiving opening; and a blade-dressing assembly configured to provide selective dressing of the blade, said blade-dressing assembly including a carrier and a dressing component supported on the carrier, said dressing component presenting a dressing surface configured to engage the blade and thereby dress the blade when the blade is moved relative to the dressing surface, said carrier being shiftably supported on the housing so as to move between a storage position in which the dressing surface is incapable of engaging the blade and an operating position in which the dressing surface is engageable by the blade, said carrier being pivotally connected to the housing so as to swing between the storage and operating positions, said housing presenting an outer surface, said carrier including a projecting portion that projects outwardly from the outer surface of the housing when the carrier is in the storage position, said projecting portion defining a handle to be manually grasped and pulled when the carrier is swung from the storage position to the operating position, said carrier including a body portion from which the projecting portion extends, said body portion including an outer face that is generally flush with the outer surface of the housing when the carrier is in the storage position.

15. The container as claimed in claim 14, said projecting portion being configured to engage a surface upon which the container rests when the carrier is in the operating position, said projecting portion spacing the body portion from the surface when the carrier is in the operating position.

16. The container as claimed in claim 15, said body portion being generally level when the carrier is in the operating position.

17. The container as claimed in claim 16, said carrier including a slot-defining portion having at least one blade-receiving slot in which the dressing component is located, said slot being at least substantially vertical when the carrier is in the operating position.

18. The container as claimed in claim 17, said slot-defining portion abutting the housing when the carrier is in the storage position so as to prevent swinging movement of the carrier beyond the storage position.

* * * * *